United States Patent [19]

Brown

[11] Patent Number: 4,896,994

[45] Date of Patent: Jan. 30, 1990

[54] HIGHWAY EXPANSION JOINT STRIP SEAL

[75] Inventor: Howard R. Brown, Bowling Green, Ohio

[73] Assignee: The D. S. Brown Company, Inc., North Baltimore, Ohio

[21] Appl. No.: 272,529

[22] Filed: Nov. 17, 1988

[51] Int. Cl.[4] ..... E01C 11/10

[52] U.S. Cl. ..... 404/64; 404/65

[58] Field of Search ..... 404/64, 65, 67, 68, 404/69, 47; 14/16.5; 52/396, 403

[56] References Cited

U.S. PATENT DOCUMENTS

| | | | |
|---|---|---|---|
| 3,888,599 | 6/1975 | Reifsnyder | 404/69 |
| 3,994,609 | 11/1976 | Puccio | 404/69 |
| 4,067,660 | 1/1978 | Puccio | 404/65 |
| 4,119,387 | 10/1978 | Brown | 404/64 |
| 4,148,167 | 4/1979 | Puccio | 404/69 |
| 4,179,226 | 12/1979 | Puccio | 404/69 |
| 4,245,925 | 1/1981 | Pyle | 404/69 |
| 4,290,713 | 9/1981 | Brown et al. | 404/69 |
| 4,295,315 | 10/1981 | Lynn-Jones et al. | 404/69 |
| 4,362,430 | 12/1982 | Ceintrey | 404/64 |
| 4,366,590 | 1/1983 | Huber et al. | 404/64 |
| 4,367,976 | 1/1983 | Bowman | 404/68 |
| 4,447,172 | 5/1984 | Galbreath | 404/68 |
| 4,488,324 | 12/1984 | Hartkom | 14/16.5 |
| 4,616,480 | 10/1986 | Nicholas | 404/64 |
| 4,625,485 | 12/1986 | Nicholas | 404/64 |
| 4,637,085 | 1/1987 | Hartkom | 404/64 |
| 4,743,139 | 5/1988 | Spavin | 404/69 |
| 4,746,129 | 5/1988 | Puccio | 404/65 |
| 4,774,795 | 10/1988 | Braun | 404/68 |

OTHER PUBLICATIONS

Undated brochure of Structural Accesories Inc. Entitled "On-Flex ®-elastomeric Expansion Joint Sealing Systems".

Brochure of Acme Highway Products Corporation, Copyright 1983, Entitled "Acme Strip Seal-Engineered Expansion Joints".

Brochure of The D.S. Brown Company, Dated 1987, and Entitled "Steelflex ® Strip Seal Expansion Joint Systems".

*Primary Examiner*—Jerome W. Massie
*Assistant Examiner*—Gay Ann Spahn
*Attorney, Agent, or Firm*—Willian Brinks Olds Hofer Gilson & Lione

[57] ABSTRACT

An expansion joint strip seal for use between spaced apart ends of sections of a highway, bridge, or the like, the strip seal having an elongate C-shaped metallic rail embedded in the end of one of the sections, a reverse C-shaped elongate metallic rail embedded in the end of an adjacent section, and an elastomeric, elongate membrane having ear portions extending along its opposed edges, each of the ear portions being sealingly engaged by one of the metallic rails. The membrane, which is formed integrally in a single piece, has a central web portion, which is generally V-shaped in cross-section, and each ear portion has an enlarged end portion and a transitional portion between the enlarged end portion and the central web portion. The transitional portion has upper and lower horizontal surfaces which sealingly engage sealing surfaces of an entrance of the metallic rail which engages such ear portion, the entrance leading into an enlarged cavity of the rail which engages the end portion of the membrane. The end portion of the membrane is provided with spaced apart upper and lower voids to facilitate the compressing of the end portion to thereby facilitate its insertion into the cavity of the rail.

21 Claims, 1 Drawing Sheet

HIGHWAY EXPANSION JOINT STRIP SEAL

BACKGROUND OF THE INVENTION

1. Field of the Invention

This invention relates to a sealing structure for use between spaced apart ends of adjacent concrete sections of a highway, or adjacent sections of a bridge, to sealingly accommodate changes in the spacing between the sections as the result of thermal contraction and expansion.

2. Description of the Prior Art

U.S. Pat. No. 4,290,713 (D. D. Brown et al) discloses a highway expansion joint strip seal in which each of the opposed ends of an elastomeric strip is provided with a downwardly extending enlargement or bead which is engaged in an upwardly facing opening of a metallic frame. Each metallic frame for use in such strip seal is fabricated by roll forming, that is, from a flat plate by rolling operations, which is a relatively expensive manufacturing procedure. Elastomeric strips of the type illustrated in this patent have also been used in conjunction with metallic frames which are formed by extrusion, also an expensive manufacturing procedure. U.S. Pat. No. 3,994,609 (G. S. Puccio) discloses a highway expansion joint strip seal in which each of the opposed ends of an elastomeric strip is provided with an enlarged bead portion with an outwardly facing convex curved end which is received in a generally C-shaped cavity of a metallic edge member. The edge members of this reference are manufactured by extrusion. Further, expansion joint strip seals according to the prior art have been difficult to assemble due to the need to insert the enlarged ends of the elastomeric strip into the somewhat smaller opening of metallic frame of edge members. To the extent that the difficulty of assembly has been reduced by increasing the size of the openings in the metallic frame or edge members or by reducing the size of the enlarged ends of the elastomeric strip, the resistance of the elastomeric member to being pulled out of the metallic frame or edge member has been undesirably reduced.

SUMMARY OF THE INVENTION

According to the present invention there is provided an expansion joint strip seal for a highway or a bridge which is made up of a collapsible elastomeric membrane whose opposed ends are provided with enlarged ear portions, and a pair of spaced apart, opposed metallic frame or rail members each of which is embedded at an edge of a concrete highway or bridge section and each of which sealingly engages one of the opposed ends of the elastomeric strip. The elastomeric membrane is made up of an elongate, generally horizontally extending web portion, which is generally V-shaped in cross-section to provide the needed flexibility for movement of the opposed ends toward and away from each other, and a pair of enlarged, generally vertically extending ear portions which are integrally joined to opposed ends of the web portion at locations of the ear portions which are closer to the bottoms thereof than to the tops. Each of the ear portions is provided with a pair of spaced apart internal voids which facilitate the compression and distortion of the ear portion that is needed to insert it into a generally C-shaped cavity of the metallic rail member which receives such ear portion, and the eccentric positioning of each ear portion with respect to the web portion serves to provide a turning moment on the ear portion when the web portion is under tension, to thereby twist the ear portion within the cavity of the rail member in which it is engaged and thereby increase the pullout resistance of the ear portion. Further, the configuration of the membrane is such that it is feasible to produce suitable metallic frame or rail members to sealingly receive ear portions at the opposed edges of the membrane by a rolling procedure, at a substantial reduction in the manufacturing costs of such frame or rail members.

Accordingly, it is an object of the present invention to provide an improved expansion joint strip seal. It is a further object of the present invention to provide an improved highway expansion joint strip seal. More particularly, it is an object of the present invention to provide a highway expansion joint strip seal with reduced assembly difficulty between an elastomeric membrane and metallic frame members which sealingly engage opposed ends of the elastomeric membrane, and with improved pullout resistance between the elastomeric membrane and the metallic frame members. It is also an object of the present invention to provide an expansion joint strip seal in which an elastomeric membrane component thereof is of a configuration which permits the use of machined hot rolled metallic frame or rail members to sealingly engage enlarged ear portions at opposed edges of such membrane. It is also an object of the present invention to provide an improved elastomeric membrane for use in an expansion joint strip seal. For a further understanding of the present invention and the objects thereof, attention is directed to the drawing and the following description thereof, to the detailed description of the preferred embodiment and to the appended claims.

DETAILED DESCRIPTION OF THE PREFERRED EMBODIMENT

Figure 1:
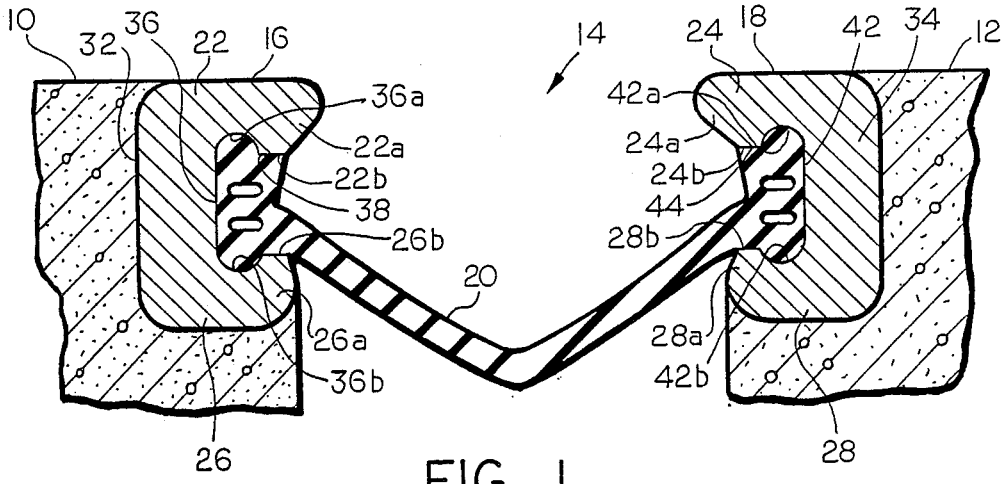
FIG. 1 is a fragmentary cross-sectional view of a joint between adjacent sections of a highway, the joint being provided with a strip seal according to a preferred embodiment of the present invention.

As is illustrated in FIG. 1, a typical highway includes multiple concrete sections, such as sections 10 and 12, whose adjacent ends 10*a* and 12*a*, respectively, are spaced apart from one another to accommodate thermal expansion and contraction of the sections 10 and 12 due to temperature changes. A strip seal, indicated generally at 14, is inserted between the ends 10*a* and 12*a* of the sections 10 and 12 to prevent moisture, dirt and other debris from filling the space between the ends 10*a* and 12*a*, and possibly wedging thereunder, with resulting damage to or deterioration of the sections 10 and 12. Of course, it is to be understood that the strip seal 14 may be used to provide for expansion and contraction between adjacent ends of other planar structures, for example, bridge sections.

The strip seal 14 is made up of generally C-shaped elongate metallic rails 16 and 18, and an elongate elastomeric membrane 20 which extends between the metallic rails 16 and 18. The metallic rails 16 and 18 are embedded in the concrete sections 10 and 12, respectively, and various types of anchoring devices, not shown, may be attached to the metallic rails 16 and 18 to assist in securely retaining them in the concrete sections 10 and 12. The use of such anchoring devices in connection with the anchoring of the metallic rails of a prior art highway strip seal in concrete highway sections is known in the prior art. See, for example, the aforesaid U.S. Pat. No. 4,290,713.

Each of the metallic rails 16 and 18 is provided with a generally horizontally extending top flange, elements 22 and 24, respectively, a generally horizontally extending bottom flange, elements 26 and 28, respectively, and a generally vertically extending web, elements 32 and 34, respectively. The web 32 of the metallic rail 16 extends from the left hand end of the top flange 22 to the left hand end of the bottom flange 26, to impart a generally C-shaped configuration to the metallic rail 16 with an internal cavity 36 having a restricted opening 38 that extends to the right, and the web 34 of the metallic rail 18 extends from the right hand end of the top flange 24 to the right hand end of the bottom flange 28 to impart a generally reverse, C-shaped configuration to the metallic rail 18 with an internal cavity 42 having a restricted opening 44 that extends to the left. The top flanges 22 and 24 have downwardly depending portions **22*a* and 24*a*, respectively, each of which ends in a horizontally extending flat surface area, elements 22*b* and 24*b*, respectively, and the bottom flanges 26 and 28 have upwardly extending portions 26*a* and 28*a*, respectively, each of which ends in a horizontally extending flat surface area, elements 26*b* and 28*b*, respectively. Thus, the opening 38 in the rail 16, which is the vertical spacing between the surface 22*b* and the surface 26*b*, has less vertical extent than the cavity 36 and is entirely spaced between the upper and lower extremities thereof, elements 36*a* and 36*b*, respectively, which are semi-circular in cross-sectional configuration, and the opening 44 in the rail 18, which is the vertical spacing between the surface 24*b* and the surface 28*b*, has less vertical extent than the cavity 42 and is entirely spaced between the upper and lower extremities thereof, elements 42*a* and 42*b* respectively, which are also semi-circular in cross-sectional configuration. Each of the rails 16 and 18 may be manufactured in one piece from steel in the illustrated, mirror image, complex configurations relatively inexpensively by conventional hot rolling techniques of the type utilized in steel mills in the manufacture of I beams and other structural steel shapes, subject, of course, to a need to machine the surfaces of the cavities 36 and 42 in the rails 16 and 18, respectively, including the surfaces of the openings 38 and 44, but nevertheless without the need to employ more expensive manufacturing techniques such as extrusion or roll forming. Of course, it is to be understood that it is also contemplated that the rails 16 and 18** may also be manufactured by extrusion or roll forming, if the product characteristics which result from either of such manufacturing processes are desired.

The elongate elastomeric membrane 20 is formed integrally in a single piece from a suitable elastomeric material, for example polychloroprene with a Durometer A hardness of approximately 60±5, and this may be done by extrusion. The membrane 20 has a generally horizontally extending web portion 52, which is generally V-shaped in cross section, and generally vertically extending, mirror image ear portions 54 and 56 which are attached to the opposed ends of the web portion 52, the V-shape of the web portion 52 facilitating the changes in spacing between the ear portions 54 and 56 to accommodate changes in spacing between the ends **10*a* and 12*a* of the highway sections 10 and 12. The ear portion 54 has a free end 54*a* which is sized and shaped to fit snugly within the cavity 36 of the rail 16, and a transitional portion 54*b* which is sized and shaped, and positioned relative to the free end 54*a*, to extend through and fit snugly within the opening 38 in the rail 16. Likewise, the ear portion 56 has a free end 56*a* which is sized and shaped to fit snugly within the cavity 42 of the rail 18, and a transitional portion 56*b* which is sized and shaped, and positioned relative to the free end 56*a*, to fit snugly within the opening 44 in the rail 18. Thus, the vertical extent of the free end 54*a* of the ear portion 54 of the membrane 20 is greater than the vertical extent of the opening 38 in the rail 16, and the free end 54*a* must be compressed in the vertical direction to permit it to be inserted through the opening 38 into the cavity 36 of the rail 16. To facilitate the compressing of the free end 54*a* of the ear portion 54, the free end 54*a* is provided with spaced apart, horizontally elongate internal cavities 62 and 64. Similarly, the vertical extent of the free end 56*a* of the ear portion 56 of the membrane 20 is greater than the vertical extent of the opening 44 in the rail 18, and the free end 54 is provided with spaced apart, horizontally extending elongate internal cavities 66 and 68 to facilitate the vertical compressing of the free end 56*a* to permit it to be inserted through the opening 44 into the cavity 42 of the rail 18. The cavity 62 is spaced a given distance from the top of the free end 54*a* of the ear 54 and the cavity 64 is spaced a slightly greater distance from the bottom of the free end 54*a*. Likewise, the cavity 66 is spaced a given distance from the top of the free end 56*a* of the ear 54 and the cavity 68 is spaced a slightly greater distance from the bottom of the free end 56*a***.

Sealing contact between the ear portion 54 of the elastomeric membrane 20 and the rail 16 primarily occurs at the surfaces **22*b* and 26*b* of the rail 16, and this end the transitional portion 54*b* of the ear portion 54 is provided with parallel, upper and lower surfaces 54*c* and 54*d*, respectively, which sealingly engage the surfaces 22*b* and 26*b*, respectively, of the rail 16. Similarly, sealing contact between the ear portion 56 of the elastomeric membrane 20 and the rail 18 primarily occurs at the surfaces 24*b* and 28*b* of the rail 18, and to this end the transitional portion 56*b* of the ear portion is provided with parallel, upper and lower surfaces 56*c* and 56*d*, respectively, which sealingly engage the surfaces 24*b* and 28*b*, respectively, of the rail 18. To ensure proper sealing engagement between the transitional portion 54*b* of the ear portion 54 and the opening 38 in the rail 16, and proper sealing engagement between the transitional portion 56*b* of the ear portion 56 and the opening 44 in the rail 18, the relaxed or uncompressed spacing between the surfaces 54*c* and 54*d* must exceed the spacing between the surfaces 22*b* and 26*b*, and the relaxed or uncompressed spacing between the surfaces 56*c* and 56*d* must exceed the spacing between the 24*b* and 28*b*. For example, it has been found that good, water tight sealing can be obtained in a strip seal 14 of the type described when the relaxed or uncompressed spacing between the surfaces 54*c* and 54*d*, which is equal to that between the surfaces 56*c* and 58*d*, is 0.860 in., and with a spacing between the surfaces 22*b*** and 26*b*, which is equal to that between the surfaces 24*b* and 28*b*, of 0.813 in..

Figure 2:
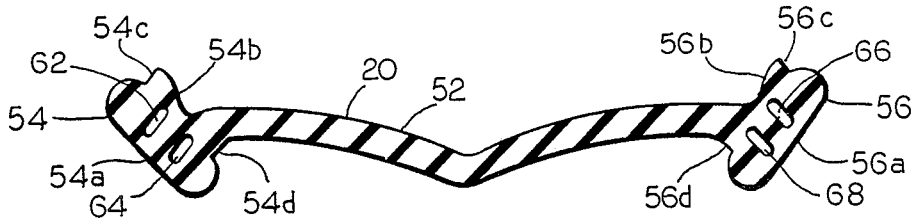
FIG. 2 is a cross-sectional view of the elastomeric membrane element of the strip seal illustrated in FIG. 1.

As is clear from a comparison of FIG. 2 and FIG. 1, in the relaxed condition of the elastomeric membrane 20, as is shown in FIG. 2, the ear portions 54 and 56 extend obliquely with respect to the horizon whereas in the assembled condition of the membrane 20 the ear portions extend vertically. Thus, a twisting movement is imparted to the ear portions 54 and 56 by the rails 16 and 18, respectively, which tends to increase the interference fit between the ear portions 54 and 56 and the openings 38 and 44, respectively, and thereby increase the resistance of the elastomeric membrane 20 to being pulled out of the rails 16 and 18 under a tensile load, for example, in exceptionally cold weather when the spacing between the ends 10*a* and 12*a* of the highway sections is large. Further, twisting of the ears 54 and 56 within the rails 16 and 18, respectively, under tensile load, is increased by positioning the junctures between the web portion 52 and the ear portions 54 and 56 eccentrically between the top and bottom of each such ear portion, preferably in alignment with the lower voids 64 and 68, respectively, and this further increases the resistance of the elastomeric member 20 to being pulled out of the rails 16 and 18 under a tensile load.

Figure 3:
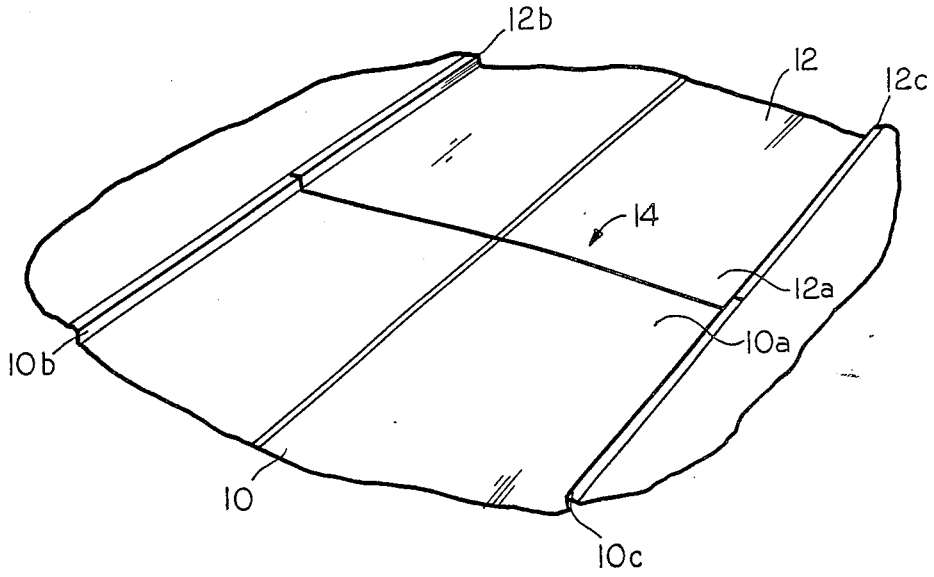
FIG. 3 is a fragmentary, perspective view of a section of a highway, including curbs, which incorporates a strip seal of the type illustrated in FIG. 1.

The use of voids 62 and 64 in the ear 54 of the elastomeric membrane 20, and the use of voids 66 and 68 in the ear 56 makes it possible to obtain fairly sharp upturns in the strip seal 14, for example, even 90° upturns. Thus, as is shown in FIG. 3, the strip seal 14 may be employed in a highway having sections 10 and 12 which have curbs 10*b* and 10*c*, and 12*b* and 12*c*, respectively, along the opposed edges thereof.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. An elongate membrane for use in a strip seal between the spaced apart ends of adjacent sections of a highway, bridge, or the like, said membrane comprising;

a web portion having first and second opposed edges:

a first ear portion attached to the first of the opposed edges of the web portion;

a second ear portion attached to the second of the opposed edges of the web portion;

each of the first ear portion and the second ear portion extending generally normally to the web portion and having an enlarged end portion and a transitional portion attached to said enlarged end portion and positioned between said enlarged end portion and the edge of the web portion to which said each of the first ear portion and the second ear portion is attached;

each transitional portion having an upper sealing surface and a lower sealing surface;

the upper sealing surface of each transitional portion being below an upper limit of the enlarged end portion to which said transitional portion is attached;

the lower sealing surface of each transitional portion being above a lower limit of the enlarged end portion to which said transitional portion is attached;

each transitional portion being attached to the edge of the web portion to which the ear portion incorporating said transitional portion is attached at a location on said transitional portion which is substantially closer to one of the upper sealing surface and the lower sealing surface thereof than to the other; and elongate void means comprising upper and lower spaced apart voids within the enlarged end portion of each of the first ear portion and the second ear portion to facilitate the compressing of each said enlarged end portion in a direction transverse to its upper limit and its lower limit;

wherein the web portion, the first end portion and the second end portion are formed integrally in a single piece from an elastomeric material; and wherein the upper void of each enlarged end portion is positioned a first distance below the upper limit of said enlarged end portion, wherein the lower void of each enlarged end portion is positioned a second given distance above the lower limit of said enlarged end portion, said second given distance being slightly greater than said first distance, and wherein the transitional portion of each ear portion is attached to the edge of the web portion to which the ear portion incorporating said transitional portion is attached at a location of said transitional portion which is approximately in alignment with the lower void of said enlarged end portion.

2. A membrane according to claim 1 wherein said web portion is generally V-shaped in transverse cross-section.

3. A membrane according to claim 1 wherein said elastomeric material is polychloroprene with a Durometer A hardness of approximately 55–65.

4. A membrane according to claim 1;

wherein the first ear portion has a first configuration;

wherein the second ear portion has a second configuration; and wherein the second configuration is a mirror image of the first configuration.

5. A membrane according to claim 1;

wherein said membrane has a relaxed state, wherein said web portion of said membrane extends generally horizontally in the relaxed state of said membrane, and wherein each of the first ear portion and the second ear portion extends obliquely with respect to the horizon in the relaxed state of said membrane.

6. An elongate membrane according to claim 1 wherein said upper sealing surface and said lower sealing surface of said each transitional portion extend generally horizontally.

7. A strip seal for use between the spaced apart ends of adjacent sections of a highway, bridge, or the like, said strip seal comprising:

a membrane, said membrane comprising;

a web portion having first and second opposed edges, a first ear portion attached to the first of the opposed edges of the web portion, a second ear portion attached to the second of the opposed edges of the web portion, each of portion of the first ear portion and the second ear portion extending generally normally to the web portion and having an enlarged end portion and a transitional portion attached to said enlarged end portion and positioned between said enlarged end portion and the edge of the web portion to which said each of the first ear portion and the second ear portion is attached, each transitional portion having an upper sealing surface and a lower sealing surface, the upper sealing surface of each transitional portion being below an upper limit of the enlarged end portion to which said transitional portion is attached, the lower sealing surface of each transitional portion being above a lower limit of the enlarged end portion to which said transitional portion is attached, each transitional portion further being attached to the edge of the web portion to which the ear portion incorporating said transitional portion is attached at a location on said transitional portion which is substantially closer to one of the upper sealing surface and the lower sealing surface thereof than to the other, and elongate void means comprising upper and lower spaced apart voids within the enlarged end portion of each of the first ear portion and the second ear portion of the membrane to facilitate the compressing of each said enlarged end portion in a direction transverse to its upper limit and its lower limit, wherein the web portion, the first ear portion and the second ear portion are formed integrally in a single piece from an elastomeric material;

a first elongate rail, said first elongate rail being formed from a rigid material and being generally C-shaped in transverse cross section, said first elongate rail having an internal cavity in which the free end of the first ear portion of the membrane is snugly contained and an opening through which the transitional portion of the first ear portion passes, the opening of the first elongate rail having an upper sealing surface which sealingly engages the upper sealing surface of the transitional portion of the first ear portion and a lower sealing surface which sealingly engages the lower sealing surface of the transitional portion of the first ear portion; and a second elongate rail, said second elongate rail being formed from a rigid material and being generally reverse C-shaped in transverse cross section, said second elongate rail having an internal cavity in which the free end of the second ear portion is snugly contained and an opening through which the transitional portion of the second ear portion passes, the opening of the second elongate rail having an upper sealing surface which sealingly engages the upper sealing surface of the transitional portion of the second ear portion and a lower sealing surface which sealingly engages the lower sealing surface of the transitional portion of the second ear portion;

wherein the upper void of each enlarged end portion of the membrane is positioned a first distance below the upper limit of said enlarged end portion, wherein the lower void of each enlarged end portion of the membrane is positioned a second given distance above the lower limit of said enlarged end portion, said second given distance being slightly greater than said first distance, and wherein the transitional portion of each ear portion of the membrane is attached to the edge of the web portion to which the ear portion incorporating said transitional portion is attached at a location of said transitional portion which is approximately in alignment with the lower void of said enlarged end portion.

8. A strip seal according to claim 7 wherein said web portion of said membrane is generally V-shaped in transverse cross section.

9. A strip seal according to claim 7 wherein said elastomeric material is polychloroprene with a Durometer A hardness of approximately 55–65.

10. A strip seal according to claim 7;

wherein the first ear portion of said membrane has a first configuration;

wherein the second ear portion of said membrane has a second configuration; and wherein the second configuration is a mirror image of the first configuration.

11. A strip seal according to claim 7 wherein said first elongate rail is a metallic rail and wherein said second elongate rail is a metallic rail.

12. A strip seal according to claim 11 wherein said first elongate rail is a hot rolled steel rail and wherein said second elongate rail is a hot rolled steel rail.

13. A strip seal according to claim 7 wherein said upper sealing surface and said lower sealing surface of said each transitional portion of said membrane extend generally horizontally.

14. A strip seal for use between the spaced apart ends of adjacent sections of a highway, bridge, or the like, said strip seal comprising:

a membrane, said membrane comprising;

a web portion having first and second opposed edges, a first ear portion attached to the first of the opposed edges of the web portion, a second ear portion attached to the second of the opposed edges of the web portion, each of the first ear portion and the second ear portion extending generally normally to the web portion and having an enlarged end portion and a transitional portion attached to said enlarged end portion and positioned between said enlarged end portion and the edge of the web portion to which said each of the first ear portion and the second ear portion is attached, each transitional portion having an upper sealing surface and a lower sealing surface, the upper sealing surface of each transitional portion being above a lower limit of the enlarged end portion to which said transitional portion is attached, and each transitional portion further being attached to the edge of the web portion to which the ear portion incorporating said transitional portion is attached at a location on said transitional portion which is substantially closer to one of the upper sealing surface and the lower sealing surface thereof than to the other;

a first elongate rail, said first elongate rail being formed from a rigid material and being generally C-shaped in transverse cross section, said first elongate rail having an internal cavity in which the free end of the first ear portion of the membrane is snugly contained and an opening through which the transitional portion of the first ear portion passes, the opening of the first elongate engages the upper sealing surface of the transitional portion of the first ear portion and a lower sealing surface which sealingly engages the lower sealing surface of the transitional portion of the first ear portion; and a second elongate rail, said second elongate rail being formed from a rigid material and being generally reverse C-shaped in transverse cross section, said second elongate rail having an internal cavity in which the free end of the second ear portion is snugly contained and an opening through which the transitional portion of the second ear portion passes, the opening of the second elongate rail having an upper sealing surface which sealingly engages the upper sealing surface of the transitional portion of the second ear portion and a lower sealing surface which sealingly engages the lower sealing surface of the transitional portion of the second ear portion;

wherein said upper sealing surface of said first elongate rail, said lower sealing surface of said first elongate rail, said upper sealing surface of said second elongate rail, and said lower sealing surface of said second elongate rail extend generally horizontally.

15. A strip seal for use between the spaced apart ends of adjacent sections of a highway, bridge, or the like, said strip seal comprising:

a membrane, said membrane comprising:

a web portion having first and second opposed edges, a first ear portion attached to the first of the opposed edges of the web portion, a second ear portion attached to the second of the opposed edges of the web portion, the web portion, the first ear portion and the second ear portion being formed integrally in a single piece from an elastomeric material, elongate void means within the enlarged end portion of each of the first ear portion of the membrane and the second ear portion of the membrane, each elongate void mans comprising upper and lower spaced apart voids, each of the first ear portion of the membrane and the second ear portion of the membrane extending generally normally to the web portion of the membrane and having an enlarged end portion and a transitional portion attached to said enlarged end portion and positioned between said enlarged end portion and the edge of the web portion to which said each of the first ear portion; and the second ear portion is attached, each transitional portion having an upper sealing surface and a lower sealing surface, the upper sealing surface of each transitional portion being below an upper limit of the enlarged end portion to which said transitional portion is attached, the lower sealing surface of each transitional portion being above a lower limit of the enlarged end portion to which said transitional portion is attached, and each transitional portion further being attached to the edge of the web portion to which the ear portion incorporating said transitional portion is attache at a location on said transitional portion which is substantially closer to one of the upper sealing surface and the lower sealing surface thereof than to the other;

a first elongate rail, said first elongate rail being formed from a rigid material and being generally C-shaped in transverse cross section, said first elongate rail having an internal cavity in which the free end of the first ear portion of the membrane is snugly contained and an opening through which the transitional portion of the first ear portion passes, the opening of the first elongate rail having an upper sealing surface which sealingly engages the upper sealing surface of the transitional portion of the first ear portion and a lower sealing surface which sealingly engages the lower sealing surface of the transitional portion of the first ear portion; and a second elongate rail, said second elongate rail being formed from a rigid material and being generally reverse C-shaped in transverse cross section, said second elongate rail having an internal cavity in which the free end of the second ear portion is snugly contained and an opening through which the transitional portion of the second ear portion passes, the opening of the second elongate rail having an upper sealing surface which sealingly engages the upper sealing surface of the transitional portion of the second ear portion and a lower sealing surface which sealingly engages the lower sealing surface of the transitional portion of the second ear portion;

wherein said upper sealing surface of said first elongate rail, said lower sealing surface of said first elongate rail, said upper sealing surface of said second elongate rail, and said lower sealing surface of said second elongate rail extend generally horizontally.

16. A strip seal according to claim 15 wherein the web portion of the membrane is generally V-shaped in transverse cross section.

17. A strip seal according to claim 16 wherein the elastomeric material of the membrane is polychloroprene with a Durometer A hardness of approximately 55–65.

18. A strip seal according to claim 16;

wherein the first ear portion of said membrane has a first configuration, wherein the second ear portion of said membrane has a second configuration, and wherein the second configuration is a mirror image of the first configuration.

19. A strip seal according to claim 15 wherein said first elongate rail is a metallic rail and wherein said second elongate rail is a metallic rail.

20. A strip seal according to claim 19 wherein said first elongate rail is a hot rolled steel rail and wherein said second elongate rail is a hot rolled steel rail.

21. A strip seal according to claim 15 wherein said upper sealing surface and said lower sealing surface of said each transitional portion of said membrane extend generally horizontally.

* * * * *